US008741217B2

(12) United States Patent
Matsumoto et al.

(10) Patent No.: US 8,741,217 B2
(45) Date of Patent: Jun. 3, 2014

(54) TITANIUM ALLOY FOR CORROSION-RESISTANT MATERIALS

(75) Inventors: Satoshi Matsumoto, Osaka (JP); Keisuke Nagashima, Osaka (JP); Takashi Maeda, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 125 days.

(21) Appl. No.: 12/815,527

(22) Filed: Jun. 15, 2010

(65) Prior Publication Data

US 2010/0310410 A1 Dec. 9, 2010

Related U.S. Application Data

(63) Continuation-in-part of application No. 12/087,066, filed as application No. PCT/JP2006/315132 on Jul. 31, 2006, now abandoned.

(30) Foreign Application Priority Data

Dec. 28, 2005 (JP) ..... 2005-377163

(51) Int. Cl.
*C22C 14/00* (2006.01)

(52) U.S. Cl.
USPC ..... 420/417; 420/418; 420/419; 420/421

(58) Field of Classification Search
USPC ..... 148/421, 669; 420/417–421
See application file for complete search history.

(56) References Cited

U.S. PATENT DOCUMENTS

| | | | | | |
|---|---|---|---|---|---|
| 4,568,398 | A * | 2/1986 | Wood et al. | ..... | 148/421 |
| 5,156,807 | A * | 10/1992 | Nagata et al. | ..... | 420/417 |
| 5,437,835 | A | 8/1995 | Sugizaki et al. | | |
| 5,478,524 | A | 12/1995 | Nakanose et al. | | |
| 6,582,833 | B2 * | 6/2003 | Noda et al. | ..... | 428/610 |

FOREIGN PATENT DOCUMENTS

| | | | | |
|---|---|---|---|---|
| EP | 0 348 593 | | 1/1990 | |
| JP | 61-127844 | | 6/1986 | |
| JP | 61-194142 | | 8/1986 | |
| JP | 62-70543 | | 4/1987 | |
| JP | 62-107041 | | 5/1987 | |
| JP | 62-109936 | | 5/1987 | |
| JP | 62-199744 | | 9/1987 | |
| JP | 63-103045 | | 5/1988 | |
| JP | 1-96345 | | 4/1989 | |
| JP | 3-197638 | | 8/1991 | |
| JP | 4-57735 | | 9/1992 | |
| JP | 4-308051 | | 10/1992 | |
| JP | 04-365828 | | 12/1992 | |
| JP | 06-002173 | | 1/1994 | |
| JP | 6-89423 | | 11/1994 | |
| JP | 9-87896 | | 3/1997 | |
| JP | 2000-144287 | * | 5/2000 | ..... C22C 14/00 |
| JP | 2000-248324 | | 9/2000 | |
| RU | 1 621 543 | | 8/1994 | |

OTHER PUBLICATIONS

N.F. Anoshkin et al., Titanium Alloys, Moscow, 'Metallurgy', 1980, pp. 11 and 127.
Full English Translation of Kitayama JP 06-002173—Published Jan. 11, 1994.
Full English Translation of Taki JP 04-365828—Published Dec. 17, 1992.

* cited by examiner

*Primary Examiner* — Jessee Roe
(74) *Attorney, Agent, or Firm* — Clark & Brody

(57) ABSTRACT

There is provided a titanium alloy for corrosion-resistant materials, which contains 0.01-0.12% by mass in total of at least one of platinum group elements; at least Si and one of, or both of, Sn and Mn, selected from the group consisting of Al, Cr, Zr, Nb, Si, Sn and Mn, wherein the total content of Al, Cr, Zr, Nb, Si, Sn and Mn is 5% by mass or less; and the residue comprising Ti and impurities.

2 Claims, No Drawings

TITANIUM ALLOY FOR CORROSION-RESISTANT MATERIALS

REFERENCE TO PRIOR APPLICATIONS

This application is a continuation-in-part of patent application U.S. Ser. No. 12/087,066, filed Jun. 25, 2008, now abandoned, which is a National Phase Entry of International Application No. PCT/JP2006/315132 filed on Jul. 31, 2006 hereby incorporated by reference.

FIELD OF THE INVENTION

The present invention relates to a titanium alloy for corrosion-resistant materials.

BACKGROUND OF THE INVENTION

Titanium forms thereon an oxidized film and therefore is not easily corroded as compared with general metals, so that it is widely used in a place requiring corrosion resistance. However, in this intended use, there is a demand for titanium having more excellent corrosion resistance, and in order to deal with it, corrosion resistance is improved hitherto by adding another element to titanium.

For example, as titanium having improved corrosion resistance, Ti—Pd alloys, which are also prescribed in JIS 11 type, 12 type and 13 type, are known. These are alloys containing 0.12-0.25% by mass of Pd in pure titanium. Also, it is conventional to contain therein Co, Ni or the like other than Pd (cf. Patent Documents 1 and 2).

Meanwhile, titanium has excellent characteristics as compared with general metals, and specifically it has not only excellent corrosion resistance but also a light weight and a high strength, and therefore various alloys are used in various applications, such as sports goods such as golf clubs and bicycles. However, titanium alloys are expensive compared with general metals, and in these days, utilization of low cost, recycled titanium alloys, which are obtained by recycling not only sponge titanium produced from titanium ores, but also titanium alloys, which were once introduced into markets and had become out of use, are now being studied.

However, when even a small amount of another element is mixed in titanium for which corrosion resistance is required as mentioned above, corrosion may occur starting at such an element, and therefore recycled titanium alloys are not used for titanium alloys for corrosion-resistant materials. Furthermore, platinum group elements, such as Pd, are generally expensive compared with titanium and therefore titanium alloys for corrosion-resistant materials have been very expensive in the past.

In other words, conventional titanium alloys for corrosion-resistant materials have a problem in that they cannot be produced at low cost while maintaining the capability to suppress the deterioration of corrosion resistance.

Patent Document 1: Japanese Patent No. 2132925

Patent Document 2: Japanese Patent Application Publication No. Hei-4-57735

SUMMARY OF THE INVENTION

Problems to be Solved by the Invention

In consideration of the above problems, it is an object of the present invention to provide a titanium alloy for corrosion-resistant materials that is capable of being produced at low cost while maintaining the capability to suppress the deterioration of corrosion resistance.

The present inventors intensively studied in order to solve the above problems, consequently found that it is possible to suppress the deterioration of corrosion resistance when a certain amount or less of at least one of Al, Cr, Zr, Nb, Si, Sn and Mn is contained in a titanium alloy, and thus achieved the present invention.

Specifically, according to the present invention, there is provided a titanium alloy for corrosion-resistant materials, which contains 0.01-0.12% by mass in total of at least one of platinum group elements; at least Si and one of, or both of, Sn and Mn, selected from the group consisting of Al, Cr, Zr, Nb, Si, Sn and Mn, wherein the total content of Al, Cr, Zr, Nb, Si, Sn and Mn is 5% by mass or less; and the residue comprising Ti and impurities.

By containing further Si and one of, or both of, Sn and Mn in a titanium alloy is meant that these elements are present in the titanium alloy in an amount exceeding the unavoidable level. The content of the above mentioned Al, Cr, Zr, Nb, Si, Sn and Mn can be measured by using a conventionally used analytic instrument. Usually, the contents, as the unavoidable levels, of these elements present in a titanium alloy are, at maximum, Al: 0.007% by mass, Cr: 0.007% by mass, Zr: 0.001% by mass, Nb: 0.001% by mass, Si: 0.004% by mass, Sn: 0.001% by mass and Mn: 0.001% by mass, respectively. Accordingly, by containing Al, Cr, Zr, Nb, Si, Sn and Mn in a titanium alloy is meant in the specification of this application that these elements each are present in the titanium alloy in an amount exceeding the corresponding amount.

Advantages of the Invention

According to the present invention, Al, Cr, Zr, Nb, Si, Sn or Mn is contained in a titanium alloy for corrosion-resistant materials, so that it is possible to reuse recycled titanium alloys coming from products in which at least one of Al, Cr, Zr, Nb, Si, Sn and Mn is used. In addition, according to the present invention, 0.01-0.12% by mass in total of at least one of platinum group elements is contained in the titanium alloy for corrosion-resistant materials, and the total content of Al, Cr, Zr, Nb, Si, Sn and Mn is 5% by mass or less. Whereby, it is possible to suppress the deterioration of corrosion resistance.

In other words, it is possible to provide a titanium alloy for corrosion-resistant materials that is capable of being produced at low cost while maintaining the capability to suppress the deterioration of corrosion resistance.

DETAILED DESCRIPTION OF THE PREFERRED EMBODIMENT

Now, the description will be made for a preferred embodiment of a titanium alloy for corrosion-resistant materials. First, the description will be made for the amount of each element contained in a titanium alloy for corrosion-resistant materials and the reason for determining the amount thereof.

A titanium alloy for corrosion-resistant materials of this embodiment usually contains a platinum group element, one of, or both of, Co and Ni, at least one of Al, Cr, Zr, Nb, Si, Sn and Mn, and the residue comprising Ti and impurities.

The platinum group element is an essential component of a titanium alloy for corrosion-resistant materials, and the content thereof is 0.01-0.12% by mass. The content of the platinum group element is 0.01-0.12% for the reason that when the platinum group element is less than 0.01% by mass, the corrosion resistance of the titanium alloy for corrosion-resistant materials does not reach a satisfactory level, which may cause corrosion, and on the other hand, even when the content thereof exceeds 0.12% by mass, it cannot be expected to have the corrosion resistance improved as the increase of the content thereof, and in addition, there is a possibility of increasing the cost of a titanium alloy for corrosion-resistant materials.

As this platinum group element, it is possible to use Ru, Rh, Pd, Os, Ir and Pt, and preferably use Pd.

Co and Ni are optional components, and the content thereof is 0.05-2.00% by mass. They are contained in the amount of 0.05-2.00% by mass, thereby producing an advantage of further improving the corrosion resistance while increasing the strength of the titanium alloy for corrosion-resistant materials. When the total amount of Co and Ni is less than 0.05% by mass, it is difficult to produce the advantage of further improving the corrosion resistance while increasing the strength of the titanium alloy.

Si, and one of, or both of, Sn and Mn are essential components of a titanium alloy for corrosion-resistant materials, whereas Al, Cr, Zr and Nb may not necessarily be contained. The total content of Al, Cr, Zr, Nb, Si, Sn and Mn is 5% by mass or less. These elements are contained in such a range for the reason that when the total content of Al, Cr, Zr, Nb, Si, Sn and Mn exceeds 5%, the corrosion resistance of the titanium alloy for corrosion-resistant materials is deteriorated, which causes corrosion. From these points of view, the total content of them is preferably 3% or less, and more preferably 2% or less.

Examples of impurities include unavoidable impurities such as C, O, H and Fe, and a small amount of another element may be contained in the titanium alloy for corrosion-resistant materials to such an extent as not to deteriorate the advantages of the present invention. Especially, V, Mo and W are known as the elements causing less influences on the corrosion resistance, and can be contained in a titanium alloy for corrosion-resistant materials as long as the total content thereof is about 5% by mass or less.

The titanium alloy for corrosion-resistant materials mentioned above is preferably used for conduits, heat exchangers, electrolysis vessels and the like of such as a nickel refining plant, which are used in environments, in which they are exposed to concentrated sulfuric acid, nickel sulfate or nickel chloride at about 250° C.

EXAMPLES

Now, the description will be made for the present invention in more detail with reference to examples without intention to limit the present invention thereto.

Preparation of Samples

Reference Examples 1 to 29, Examples 1 to 10, Comparative Examples 1 to 11, and Conventional Examples 1 to 4

Titanium alloys for corrosion-resistant materials are prepared by adjusting samples for evaluation on corrosion resistance of the respective Examples and Comparative Examples, using pure titanium and the respective components so as to have the components of Tables 1 and 2 contained in the amounts of Tables 1 and 2. For Comparative Example 1, pure titanium is used.

First, the titanium alloy of each composition is produced with a size having a thickness of 20 mm, a width of 70 mm and a length of 90 mm by melting through button arc melting.

Then, the thus produced pieces each are hot rolled into 3 mm thickness, and then acid-washed, thereby removing scale from the surface, and cut into a test piece having a width of 50 mm and a length of 100 mm. Then, one side of this test piece is polished with a #200 polishing sheet, while the lateral and rear sides thereof were sealed with a sealing agent, thereby allowing only the polished surface to be exposed to the surface. Thus, each sample for evaluation of corrosion resistance is prepared.

As a conventional titanium alloy for corrosion-resistant materials produced from sponge titanium or the like, a titanium alloy for corrosion resistance (Conventional Examples 1-4) containing the components shown in Table 3 are prepared and evaluated in the same manner as in Examples and Comparative Examples.

TABLE 1

| | Components (%) * | | | | | | | | | | |
|---|---|---|---|---|---|---|---|---|---|---|---|
| | Pd | Co | Ni | Mn | Sn | Al | Cr | Zr | Nb | Si | Total ** |
| Reference Example 1 | 0.05 | | | 3 | | | | | | | 3 |
| Reference Example 2 | 0.05 | 0.35 | | 4 | | | | | | | 4 |
| Reference Example 3 | 0.05 | | | | 3 | | | | | | 3 |
| Reference Example 4 | 0.02 | | | | | 3 | | | | | 3 |
| Reference Example 5 | 0.1 | | | | | 3 | | | | | 3 |
| Reference Example 6 | 0.05 | 0.35 | | 1 | 1 | | | | | | 2 |
| Reference Example 7 | 0.05 | 0.1 | 0.15 | 3 | | | | | | | 3 |
| Reference Example 8 | 0.05 | | | | | 0.01 | | 0.01 | | | 0.02 |
| Reference Example 9 | 0.05 | 0.35 | | | | 0.01 | 0.01 | | | | 0.02 |
| Reference Example 10 | 0.05 | | 0.35 | | | 0.01 | | | | 0.01 | 0.02 |
| Reference Example 11 | 0.05 | 0.2 | 0.15 | | 0.01 | 0.01 | | | | | 0.02 |

TABLE 1-continued

| | Components (%) * | | | | | | | | | | |
|---|---|---|---|---|---|---|---|---|---|---|---|
| | Pd | Co | Ni | Mn | Sn | Al | Cr | Zr | Nb | Si | Total ** |
| Reference Example 12 | 0.05 | | | | | 4 | | | | | 4 |
| Reference Example 13 | 0.05 | | | | | | 3.5 | | | | 3.5 |
| Reference Example 14 | 0.05 | 0.1 | 0.15 | | | | | 3 | | | 3 |
| Reference Example 15 | 0.05 | | | | | 2 | | | 2 | | 4 |
| Reference Example 16 | 0.05 | | | | | | | | | 2 | 2 |
| Reference Example 17 | 0.05 | | | | | 0.1 | | 0.2 | 0.2 | | 0.5 |
| Reference Example 18 | 0.05 | | | | | 1 | | | | | 1 |
| Reference Example 19 | 0.05 | | | 1 | | | | | | | 1 |
| Reference Example 20 | 0.05 | | | | | 0.5 | | 0.5 | | | 1 |
| Reference Example 21 | 0.05 | | | | 1 | 1 | | | | | 2 |
| Reference Example 22 | 0.05 | | | | | | 1 | | 1 | | 2 |
| Reference Example 23 | 0.05 | | | | | | 0.1 | | | | 0.1 |
| Reference Example 24 | 0.05 | | | | | 0.1 | | | | | 0.1 |
| Reference Example 25 | 0.05 | | | | | 0.4 | | | | | 0.4 |
| Reference Example 26 | 0.05 | | | | | | 1 | | | | 1 |
| Reference Example 27 | 0.05 | | | | | | | 1 | | | 1 |
| Reference Example 28 | 0.05 | | | | | | | | 1.5 | | 1.5 |
| Reference Example 29 | 0.05 | | | | | 1 | | | 0.6 | | 1.6 |
| Example 1 | 0.05 | | | 0.5 | | | | | | 2 | 2.5 |
| Example 2 | 0.10 | | | 1 | 1 | | | | | 2 | 4.0 |
| Example 3 | 0.05 | | | | 0.5 | | | | | 2 | 2.5 |
| Example 4 | 0.05 | | | 2 | | | | | | 0.5 | 2.5 |
| Example 5 | 0.05 | | | 2 | | | | | | 0.1 | 2.1 |
| Example 6 | 0.05 | | | | 2 | 0.5 | | | | 0.1 | 2.6 |
| Example 7 | 0.05 | | | | 4 | | | | | 0.1 | 4.1 |
| Example 8 | 0.05 | | | 1 | 1 | | | | | 1 | 3.0 |
| Example 9 | 0.05 | | | 1 | | | | | | 1 | 2.0 |
| Example 10 | 0.05 | | | | 1 | | | | | 1 | 2.0 |

* The numerals in Table are given in percent by mass.

** The total content of Mn, Sn, Al, Cr, Zr, Nb and Si is represented.

TABLE 2

| | Components (%) * | | | | | | | | | | |
|---|---|---|---|---|---|---|---|---|---|---|---|
| | Pd | Co | Ni | Mn | Sn | Al | Cr | Zr | Nb | Si | Total ** |
| Comparative Example 1 | — | | | | | | | | | | 0 |
| Comparative Example 2 | 0.05 | | | 6 | | | | | | | 6 |
| Comparative Example 3 | 0.05 | | 0.35 | 6 | | | | | | | 6 |
| Comparative Example 4 | 0.05 | | | | 6 | | | | | | 6 |
| Comparative Example 5 | 0.05 | | | | | 3 | | | 3 | | 6 |
| Comparative Example 6 | 0.05 | 0.1 | 0.2 | 6 | | | | | | | 6 |
| Comparative Example 7 | 0.05 | | | | | 6 | | | 7 | | 13 |
| Comparative Example 8 | 0.05 | | | | | 2 | 5 | | | | 7 |
| Comparative Example 9 | 0.05 | | | | | | | 6 | | | 6 |

TABLE 2-continued

| | Components (%) * | | | | | | | | | | |
|---|---|---|---|---|---|---|---|---|---|---|---|
| | Pd | Co | Ni | Mn | Sn | Al | Cr | Zr | Nb | Si | Total ** |
| Comparative Example 10 | 0.05 | | | | | | | | 5.5 | | 5.5 |
| Comparative Example 11 | 0.05 | | | | | | | | | 6 | 6 |

* The numerals in Table are given in percent by mass.
** The total content of Mn, Sn, Al, Cr, Zr, Nb and Si is represented.

TABLE 3

| | Components (%) * | | | | | | | | | | |
|---|---|---|---|---|---|---|---|---|---|---|---|
| | Pd | Co | Ni | Mn | Sn | Al | Cr | Zr | Nb | Si | Total ** |
| Conventional Example 1 | 0.05 | | | | | | | | | | 0 |
| Conventional Example 2 | 0.05 | 0.35 | | | | | | | | | 0 |
| Conventional Example 3 | 0.05 | | 0.35 | | | | | | | | 0 |
| Conventional Example 4 | 0.02 | 0.2 | 0.15 | | | | | | | | 0 |

* The numerals in Table are given in percent by mass.
** The total content of Mn, Sn, Al, Cr, Zr, Nb and Si is represented.

(Nickel-Chloride-Resistance Test)

The samples of Reference Examples, Examples, Comparative Examples and Conventional Examples for evaluation on corrosion resistance each are immersed in 20% nickel chloride solution at 100° C. for 100 hours, and the surface of each of the samples are observed by eyes and an optical microscope. Thus, the surface texture is evaluated. According to the result of the evaluation, it is determined as "○" for a sample in which no change is confirmed between its initial surface condition and its surface condition after the immersion in the nickel chloride solution, as "Δ" for a sample in which increase of unevenness or the like is slightly confirmed therebetween, and as "X" for a sample in which increase of unevenness or the like is apparently confirmed therebetween. The results are shown in Table 4.

The weight of each sample for evaluation of corrosion resistance is measured before and after the immersion in the nickel chloride solution by using an electronic balance that is capable of measuring the weight with the unit of 0.1 mg, and the difference thereof is calculated as a weight reduction (ΔM). The reduced amount is calculated by the following expression based on the surface area (S) of each sample for evaluation of corrosion resistance before the immersion.

$$\text{Reduced amount } (g/m^2) = \Delta M(g)/S(m^2)$$

The results are shown in Table 4.

(Heated-Sulfuric-Acid-Resistance Test)

The samples of Reference Examples, Examples, Comparative Examples and Conventional Examples for evaluation on corrosion resistance each are immersed in 5% sulfuric acid solution at 240° C. for 1 hour, and the reduced amount is determined by calculation in the same manner as in the nickel-chloride-resistance test. The results are shown in Table 4.

(Heated-Hydrochloric-Acid-Resistance Test)

The samples of Reference Examples, Examples, Comparative Examples and Conventional Examples for evaluation on corrosion resistance each are immersed in boiled 10% hydrochloric acid solution for 1 hour, and the reduced amount is determined by calculation in the same manner as in the nickel-chloride-resistance test. The results are shown in Table 4.

(Clearance-Corrosion-Resistance Test)

Two samples of each of Reference Examples, Examples, Comparative Examples and Conventional Examples are overlapped each other with the surfaces thereof facing each other, and are immersed in 20% NaCl solution at 90° C., adjusted to a pH value of 1 by hydrochloric acid, for 100 hours. Thus, the clearance-corrosion-resistance test is performed. In the same manner as in the nickel-chloride-resistance test, it is determined as "○" for a sample in which no change is confirmed between its surface conditions before and after the test, as "Δ" for a sample in which increase of unevenness or the like is slightly confirmed therebetween, and as "X" for a sample in which increase of unevenness or the like is apparently confirmed therebetween. The results are shown in Table 4.

TABLE 4

| | Nickel-Chloride-Resistance | | Heated-Sulfuric-Acid-Resistance | Heated-Hydrochloric-Acid Resistance | Clearance-Corrosion-Resistance |
|---|---|---|---|---|---|
| | Surface Texture | Reduced Amount | Reduced Amount | Reduced Amount | Surface Texture |
| Ref. Ex. 1 | ○ | <0.10 | 0.76 | 1.5 | ○ |
| Ref. Ex. 2 | ○ | <0.10 | 0.61 | 1.8 | ○ |
| Ref. Ex. 3 | ○ | <0.10 | 0.65 | 1.7 | ○ |
| Ref. Ex. 4 | ○ | 0.1 | 0.86 | 1.9 | ○ |
| Ref. Ex. 5 | ○ | <0.10 | 0.35 | 1.1 | ○ |
| Ref. Ex. 6 | ○ | <0.10 | 0.58 | 1.7 | ○ |
| Ref. Ex. 7 | ○ | <0.10 | 0.58 | 1.6 | ○ |

TABLE 4-continued

| | Nickel-Chloride-Resistance | | Heated-Sulfuric-Acid-Resistance | Heated-Hydrochloric-Acid Resistance | Clearance-Corrosion-Resistance |
|---|---|---|---|---|---|
| | Surface Texture | Reduced Amount | Reduced Amount | Reduced Amount | Surface Texture |
| Ref. Ex. 8 | ○ | <0.10 | 0.36 | 1.2 | ○ |
| Ref. Ex. 9 | ○ | <0.10 | 0.42 | 1.3 | ○ |
| Ref. Ex. 10 | ○ | <0.10 | 0.46 | 1.4 | ○ |
| Ref. Ex. 11 | ○ | <0.10 | 0.57 | 1.4 | ○ |
| Ref. Ex. 12 | ○ | <0.10 | 0.61 | 1.8 | ○ |
| Ref. Ex. 13 | ○ | <0.10 | 0.62 | 1.7 | ○ |
| Ref. Ex. 14 | ○ | <0.10 | 0.54 | 1.3 | ○ |
| Ref. Ex. 15 | ○ | <0.10 | 0.7 | 1.8 | ○ |
| Ref. Ex. 16 | ○ | <0.10 | 0.51 | 1.5 | ○ |
| Ref. Ex. 17 | ○ | <0.10 | 0.58 | 1.3 | ○ |
| Ref. Ex. 18 | ○ | <0.10 | 0.6 | 1.4 | ○ |
| Ref. Ex. 19 | ○ | <0.10 | 0.63 | 1.4 | ○ |
| Ref. Ex. 20 | ○ | <0.10 | 0.65 | 1.4 | ○ |
| Ref. Ex. 21 | ○ | <0.10 | 0.7 | 1.5 | ○ |
| Ref. Ex. 22 | ○ | <0.10 | 0.68 | 1.5 | ○ |
| Ref. Ex. 23 | ○ | <0.10 | 0.63 | 1.3 | ○ |
| Ref. Ex. 24 | ○ | <0.10 | 0.63 | 1.3 | ○ |
| Ref. Ex. 25 | ○ | <0.10 | 0.65 | 1.3 | ○ |
| Ref. Ex. 26 | ○ | <0.10 | 0.68 | 1.4 | ○ |
| Ref. Ex. 27 | ○ | <0.10 | 0.68 | 1.4 | ○ |
| Ref. Ex. 28 | ○ | <0.10 | 0.72 | 1.4 | ○ |
| Ref. Ex. 29 | ○ | <0.10 | 0.72 | 1.4 | ○ |
| Com. Ex. 1 | x | 0.26 | 13.5 | 41.2 | x |
| Com. Ex. 2 | Δ | 0.14 | 1.01 | 2.5 | Δ |
| Com. Ex. 3 | Δ | 0.15 | 1.25 | 3.5 | Δ |
| Com. Ex. 4 | Δ | 0.13 | 1.13 | 3.7 | Δ |
| Com. Ex. 5 | Δ | 0.14 | 1.01 | 2.5 | Δ |
| Com. Ex. 6 | Δ | 0.15 | 1.21 | 3.4 | Δ |
| Com. Ex. 7 | Δ | 0.25 | 1.81 | 4.2 | Δ |
| Com. Ex. 8 | Δ | 0.16 | 1.22 | 2.4 | Δ |
| Com. Ex. 9 | Δ | 0.15 | 1.1 | 2.2 | Δ |
| Com. Ex. 10 | Δ | 0.13 | 1.05 | 2.1 | Δ |
| Com. Ex. 11 | Δ | 0.14 | 1.11 | 2.2 | Δ |
| Conv. Ex. 1 | ○ | <0.10 | 0.36 | 1.2 | ○ |
| Conv. Ex. 2 | ○ | <0.10 | 0.42 | 1.3 | ○ |
| Conv. Ex. 3 | ○ | <0.10 | 0.46 | 1.4 | ○ |

TABLE 4-continued

| | Nickel-Chloride-Resistance | | Heated-Sulfuric-Acid-Resistance | Heated-Hydrochloric-Acid Resistance | Clearance-Corrosion-Resistance |
|---|---|---|---|---|---|
| | Surface Texture | Reduced Amount | Reduced Amount | Reduced Amount | Surface Texture |
| Conv. Ex. 4 | ○ | <0.10 | 0.57 | 1.4 | ○ |
| Ex. 1 | ○ | <0.10 | 0.52 | 1.5 | ○ |
| Ex. 2 | ○ | <0.10 | 0.42 | 1.3 | ○ |
| Ex. 3 | ○ | <0.10 | 0.63 | 1.3 | ○ |
| Ex. 4 | ○ | <0.10 | 0.64 | 1.4 | ○ |
| Ex. 5 | ○ | <0.10 | 0.54 | 1.4 | ○ |
| Ex. 6 | ○ | <0.10 | 0.67 | 1.6 | ○ |
| Ex. 7 | ○ | <0.10 | 0.73 | 1.8 | ○ |
| Ex. 8 | ○ | <0.10 | 0.68 | 1.7 | ○ |
| Ex. 9 | ○ | <0.10 | 0.65 | 1.4 | ○ |
| Ex. 10 | ○ | <0.10 | 0.62 | 1.5 | ○ |

*The "reduced amount" in each test is given in $g/m^2$. The "<0.10" is meant that the reduced amount is less than 0.10 $g/m^2$.

From Table 4, it is also appreciated that a titanium alloy for corrosion-resistant materials containing 0.01-0.12% by mass in total of at least one of platinum group elements; Si and one of, or both of, Sn and Mn; and the residue comprising Ti and impurities, in which the total content of Al, Cr, Zr, Nb, Si, Sn and Mn is 5% by mass or less, or a titanium alloy for corrosion-resistant materials containing 0.01-0.12% by mass in total of at least one of platinum group elements; 0.05-2.00% by mass in total of one of, or both of, Co and Ni; Si and one of, or both of, Sn and Mn; and the residue comprising Ti and impurities, in which the total content of Al, Cr, Zr, Nb, Si, Sn and Mn is 5% by mass or less, is excellent in corrosion resistance compared with the respective Comparative Examples, and has corrosion resistance equivalent to that of a conventional titanium alloy for corrosion-resistant materials using sponge titanium.

In other words, it is appreciated that the titanium alloy for corrosion-resistant materials of the present invention is capable of suppressing deterioration of corrosion resistance even though it uses recycled titanium alloys or the like, and thus being produced at low cost while maintaining the capability to suppress the deterioration of corrosion resistance.

What is claimed is:

1. A titanium alloy for corrosion-resistant materials, which consists of 0.01-0.12% by mass in total of at least one of platinum group elements; at least Si and one of, or both of, Sn and Mn, selected from the group consisting of Al, Cr, Zr, Nb, Si, Sn and Mn, wherein the total content of Al, Cr, Zr, Nb, Si, Sn and Mn is 4% by mass or less; and the residue consisting of Ti and impurities, wherein a reduced amount after immersion in 20% nickel chloride solution at 100° C. for 100 hours for the titanium alloy is less than 0.13 $g/m^2$, a reduced amount after immersion in 5% sulfuric acid solution at 240° C. for 1 hour is less than 1.01 $g/m^2$ for the titanium alloy, and a reduced amount after immersion in boiled 10% hydrochloric acid solution for 1 hour is less than 2.1 $g/m^2$ for the titanium alloy.

2. A titanium alloy for corrosion-resistant materials, which consists of 0.01-0.12% by mass in total of at least one of platinum group elements, 0.05-2.00% by mass in total of one of, or both of, Co and Ni, at least Si and one of, or both of, Sn and Mn, selected from the group consisting of Al, Cr, Zr, Nb, Si, Sn and Mn, wherein the total content of Al, Cr, Zr, Nb, Si, Sn and Mn is 4% by mass or less; and the residue consisting of Ti and impurities, wherein a reduced amount after immersion in 20% nickel chloride solution at 100° C. for 100 hours for the titanium alloy is less than 0.13 $g/m^2$, a reduced amount after immersion in 5% sulfuric acid solution at 240° C. for 1 hour is less than 1.01 $g/m^2$ for the titanium alloy, and a reduced amount after immersion in boiled 10% hydrochloric acid solution for 1 hour is less than 2.1 $g/m^2$ for the titanium alloy.

* * * * *